US008201489B2

(12) United States Patent
Juarez

(10) Patent No.: US 8,201,489 B2
(45) Date of Patent: Jun. 19, 2012

(54) GAS SYSTEM FOR AN AUTOMATIC FIREARM

(75) Inventor: Justin Juarez, Wheatland, WY (US)

(73) Assignee: Magpul Industries Corp., Boulder, CO (US)

( * ) Notice: Subject to any disclaimer, the term of this patent is extended or adjusted under 35 U.S.C. 154(b) by 0 days.

(21) Appl. No.: 12/609,827

(22) Filed: Oct. 30, 2009

(65) Prior Publication Data

US 2010/0186582 A1 Jul. 29, 2010

Related U.S. Application Data

(60) Provisional application No. 61/147,425, filed on Jan. 26, 2009.

(51) Int. Cl.
*F41A 5/18* (2006.01)

(52) U.S. Cl. ..... 89/191.01

(58) Field of Classification Search ..... 89/191.01, 89/191.02, 192, 193, 194
See application file for complete search history.

(56) References Cited

U.S. PATENT DOCUMENTS

| | | | | | |
|---|---|---|---|---|---|
| 698,107 | A * | 4/1902 | Knight | 89/149 |
| 2,388,396 | A * | 11/1945 | Eklund | 89/193 |
| 2,771,819 | A * | 11/1956 | Morse et al. | 89/191.02 |
| 3,323,418 | A * | 6/1967 | Loffler | 89/193 |
| 3,330,183 | A * | 7/1967 | Loffler | 89/193 |
| 3,359,860 | A * | 12/1967 | Muhlemann | 89/193 |
| 3,592,101 | A * | 7/1971 | Vartanian et al. | 89/193 |
| 3,595,129 | A * | 7/1971 | Bender et al. | 89/130 |
| 4,893,547 | A * | 1/1990 | Atchisson | 89/187.01 |
| 7,832,326 | B1 * | 11/2010 | Barrett | 89/191.01 |

* cited by examiner

*Primary Examiner* — Michael Carone
*Assistant Examiner* — Reginald Tillman, Jr.
(74) *Attorney, Agent, or Firm* — Geoffrey E. Dobbin

(57) ABSTRACT

The present invention is a gas system for a firearm comprising a hollow gas tube extending between a forward gas tap in a firearm's barrel and a rearward piston assembly to impinge upon and operate the firearm's bolt operating system. The system does not have a translation rod extending between the two components as in prior art systems nor does it have a rearward tap like others. As such, it balances cleanliness and weight reduction of the prior art systems and reduces moving parts.

8 Claims, 9 Drawing Sheets

GAS SYSTEM FOR AN AUTOMATIC FIREARM

CROSS-REFERENCES TO RELATED APPLICATIONS

This application claims priority as a non-provisional perfection of prior filed U.S. Provisional Application No. 61/147,425, filed Jan. 26, 2009 and incorporates the same herein by reference in its entirety.

FIELD OF THE INVENTION

The present invention relates to the field of firearms and more particularly relates to a gas system for operating a bolt operation system in a firearm.

BACKGROUND OF THE INVENTION

Automatically-powered gas-operating mechanisms for firearms are well known in the prior art. These systems allow for the extraction, ejection, and loading operations to be performed automatically by tapping into the energetic gases generated by the chemical reaction of the propellants used to accelerate the projectile.

These systems typically tap into the barrel to vent a portion of the gas used to propel the bullet and divert that gas flow to impinge on a piston which drives the mechanism. Traditional systems use a short length of porting to direct the gas to impinge upon the piston. The piston is then linked via an operating rod to the bolt carrier which then in turn operates the bolt to perform. These systems are generally referred to as gas-piston operating systems.

The typical piston gas-operating system taps into a forward section of the barrel to reduce gas pressure and temperature since both these factors are reduced as the distance from the chamber increases. The type of system is well proven in ubiquitous designs such as the AK47 and FN-FAL. Benefits of the system include relative cleanliness and ease-of-maintenance since combustion byproducts and un-burnt powder are concentrated in one area which is removed from other parts of the operating mechanism. However, detractions of this system are evident since the piston is located in a forward position and must be linked via a long operating rod to the firearm mechanism. This increases muzzle weight (which is already heavily affected by modern rail-mounted accessories), increases off-axis forces which can reduce both inherent accuracy due to barrel flex and user accuracy due to muzzle rise or other induced moments. There is also an inherent instability caused by the imbalance of the system.

A direct impingement system was developed in 1956 by Eugene Stoner. It uses a gas tube that acts on the bolt carrier itself while it acts on a piston contained inside the bolt carrier. Gas is routed into the bolt carrier, where pressure builds against the locked bolt and pushes the bolt carrier to the rear to unlock the bolt. The gas tube is then disconnected from the carrier, and the action is cycled as the bolt and carrier travel rearwards. The M-16 rifle, commonly used in the U.S. military, utilizes this system.

This direct impingement gas system has the advantage of reducing the amount of moving mechanism and weight towards the front of the weapon. This generally improves balance and handling. Additionally this system allows for an inline operating system where the piston impinges coaxially with the bore axis. This reduces the amount of torque moments on the barrel and the weapon that may be induced by an operating system that drives a non-coaxial piston and can improve accuracy both inherent in the weapon and reduce muzzle climb or other weapon rotation thereby increasing user accuracy. Rate of fire and dwell time can also be improved in this system since the gas must pressurize a larger volume inside the gas tube and travel a longer distance within that tube in order to impinge upon the piston and operate the mechanism. Overall this system offers improvement in both fully-automatic fire and improving dwell time for optimal function. However, direct impingement introduces an excessive amount of un-burnt powder residue and combustion byproducts into the core operating mechanism of the weapon such as the fire-control group. For the user this means that extra cleaning and maintenance must be performed to keep the weapon operating at optimal reliability levels.

Due to the limitations of both direct impingement and gas-piston operating systems the need for an improved system that mitigates the negative effects of each of these systems is apparent.

The new system disclosed is a hybrid gas system which integrates many of the advantages of both traditional gas-piston and direct-impingement operating systems. A direct-impingement type gas tube is used to tap into a forward section of barrel and allows the energy of the tapped gases to be redirected to power the mechanism without introducing a long and heavy operating rod. Since traditional gas-piston systems use a cylinder and piston system mounted toward the end of the weapon, a reinforced operating rod must be used to transmit linear force to the bolt carrier without buckling under compressive loads. By eliminating this part and replacing it with a lightweight gas tube, the muzzle weight is reduced.

Unlike the direct impingement system, this tube directs the gas rearward to impinge upon a piston contained within a cylinder directly mounted to the trunnion. This retains the cleanliness advantage of gas-piston systems since the piston and cylinder are removed from the bolt carrier and are separated from the fire-control group by the trunnion. This significantly reduces the amount of fouling and debris able to contaminate the firing mechanism firing unlike direct-impingement systems. Additionally torque inducing moments near the end of the barrel may be reduced since the piston mechanism is more rigid in the trunnion structure than on the cantilevered barrel which can bend on typical gas-piston systems.

While other operating systems exist that mount the piston in close proximity to the receiver, this hybrid system is different than others such as the Benelli ARGO system for the M1018 and M4 Super 90 shotguns which tap the gas closer to the chamber and would not be suitable for a rifle. Piston systems for rifles usually have a piston operating near the gas block towards the end of the barrel again to tap into a lower pressure part of the barrel and allow for some additional dwell time in-order to allow the cartridge case to extract efficiently.

Due to the physical layout and arrangement of the system, clear advantages can be obtained in select fire controllability, reduction in rate-of-fire, improved cycle and dwell time for cartridge case extraction, improved weight distribution, user maintainability, reliability and better structural rigidity.

SUMMARY OF THE INVENTION

In view of the foregoing disadvantages inherent in the known types of gas systems, this invention provides an improved gas system for a firearm. As such, the present invention's general purpose is to provide a new and improved gas system that is both clean and efficient in operation and encumbrance.

To accomplish these objectives, the gas system comprises a gas tube extending between a forward mounted gas manifold, which taps into the firearm's barrel to supply gas for the system, and a rearward mounted piston assembly, mounted on the barrel trunnion and having a piston capable of impinging upon the firearm's bolt carrier group.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the gas system is herein described. It should be noted that the articles "a", "an", and "the", as used in this specification, include plural referents unless the content clearly dictates otherwise.

Figure 1:
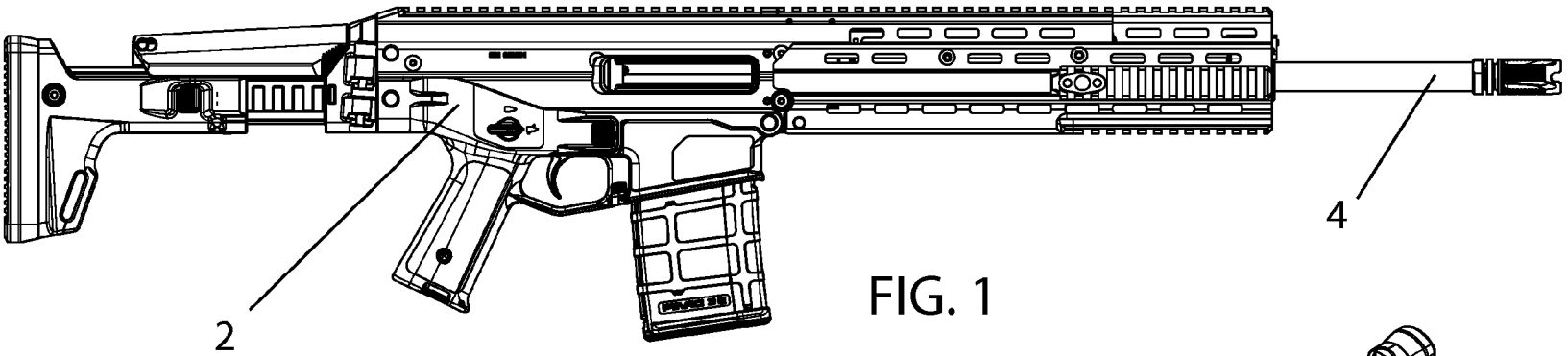
FIG. 1 is a side elevation of a firearm utilizing a gas system in accordance with the present invention.
Figure 2:
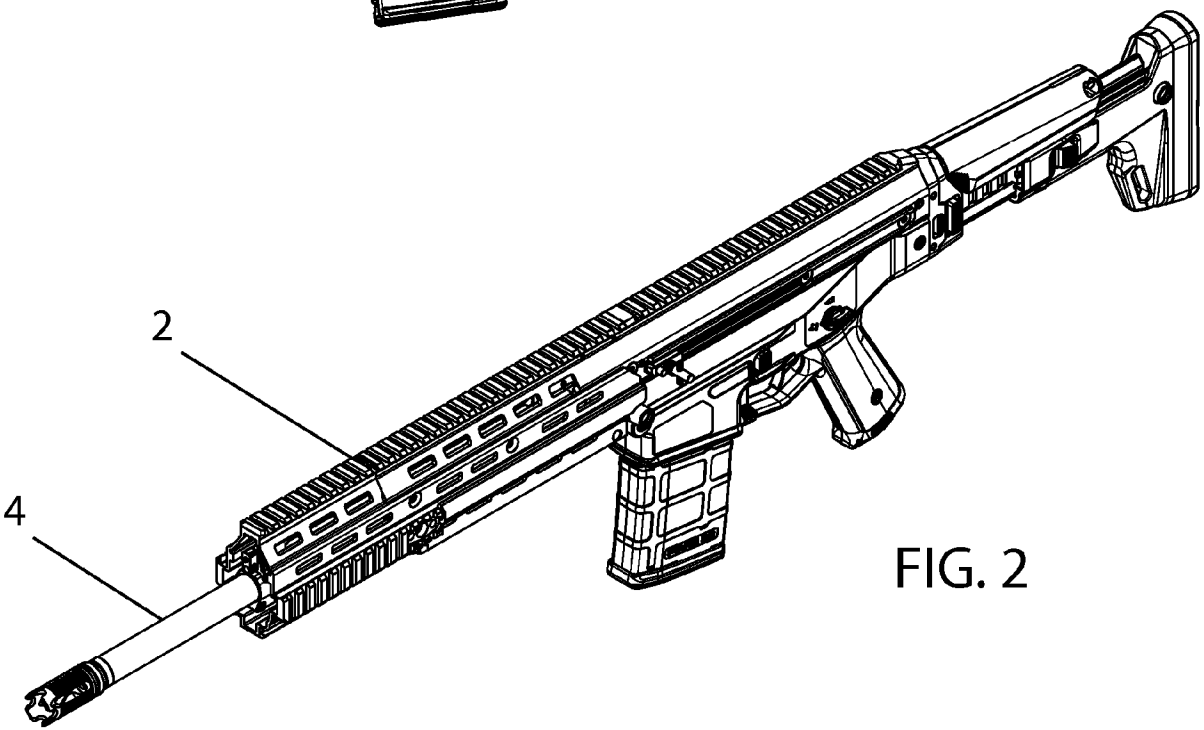
FIG. 2 is a perspective view of the firearm of FIG. 1.
Figure 3:
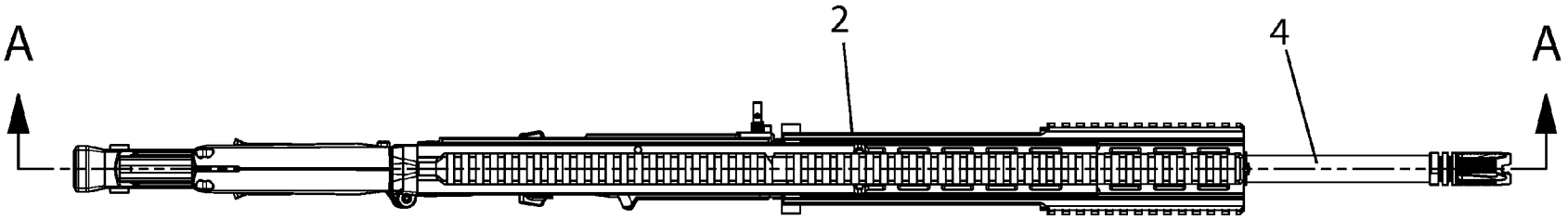
FIG. 3 is a top plan view of the firearm of FIG. 1.
Figure 4:
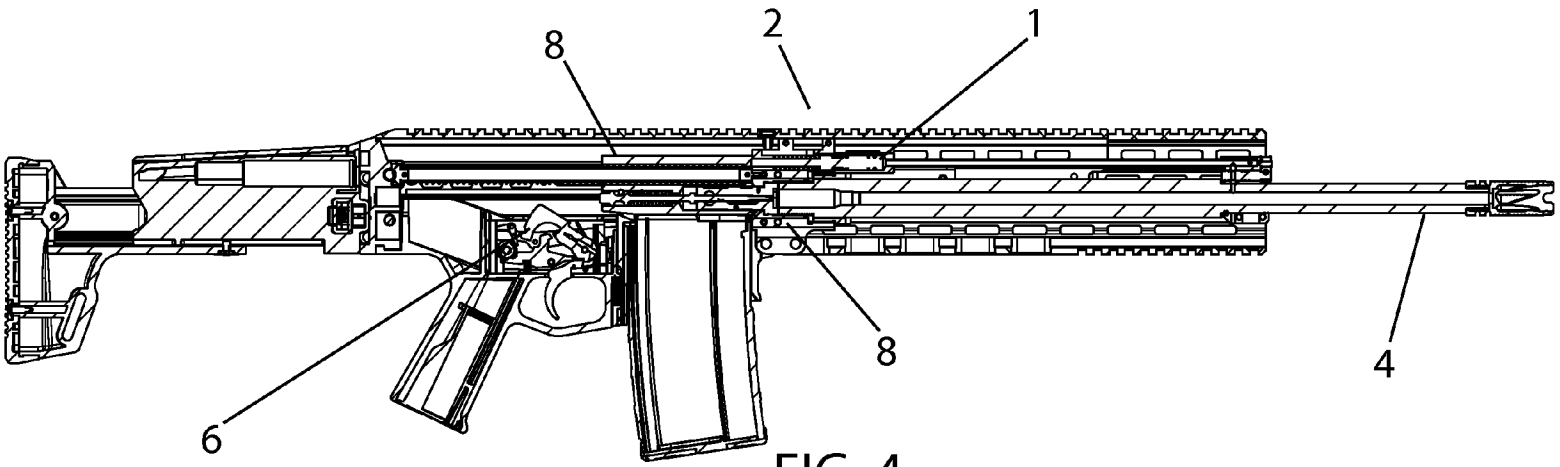
FIG. 4 is a cross-sectional view of the firearm of FIG. 3, taken along line A-A.
Figures 5, 6:
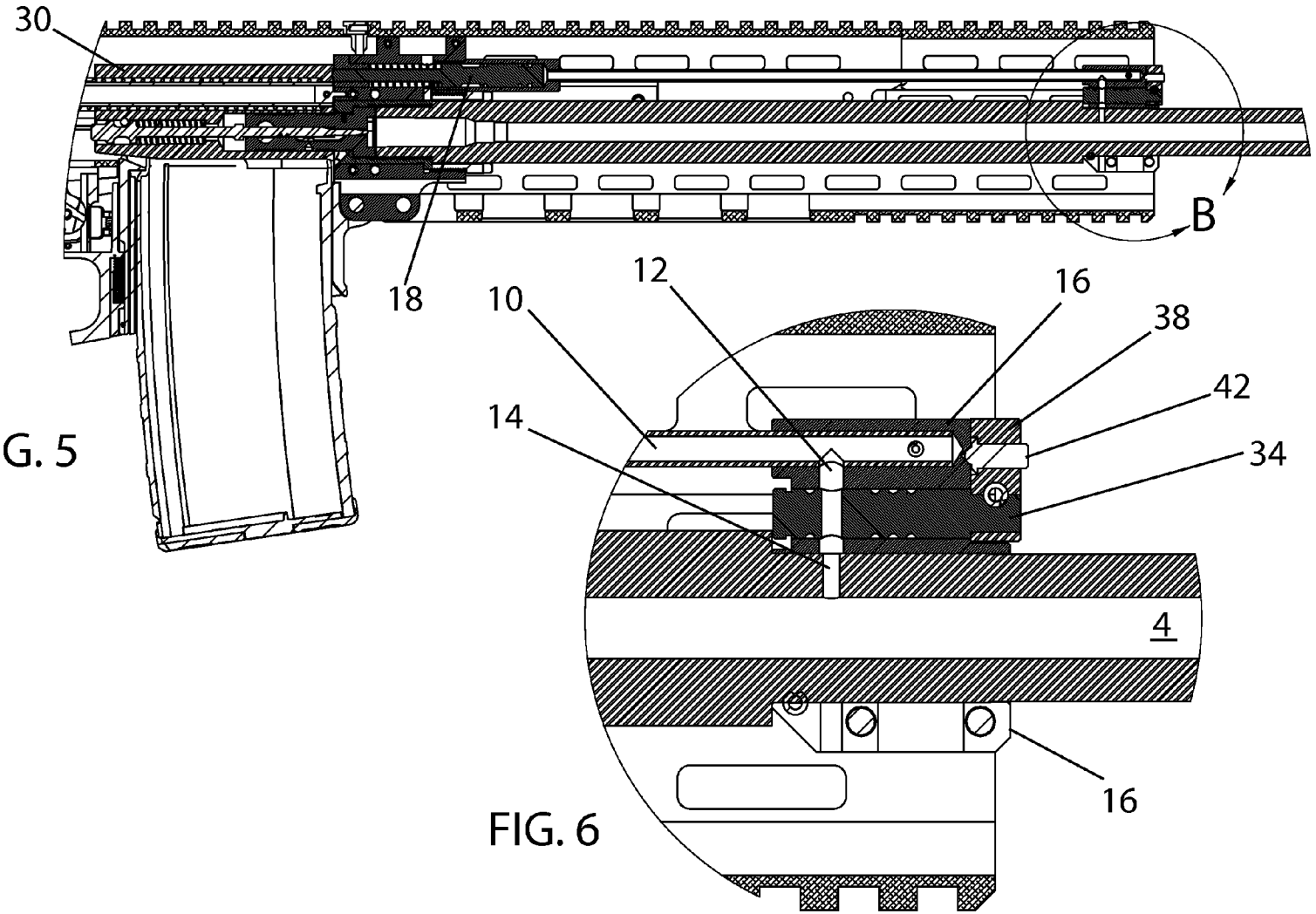
FIG. 5 is a close-up view of the firearm of FIG. 4, in a closed firing position, detailing a gas system in accordance with the present invention.
FIG. 6 is a close-up view of the fore portion of the gas system of FIG. 5, taken in circle B.
Figure 7:
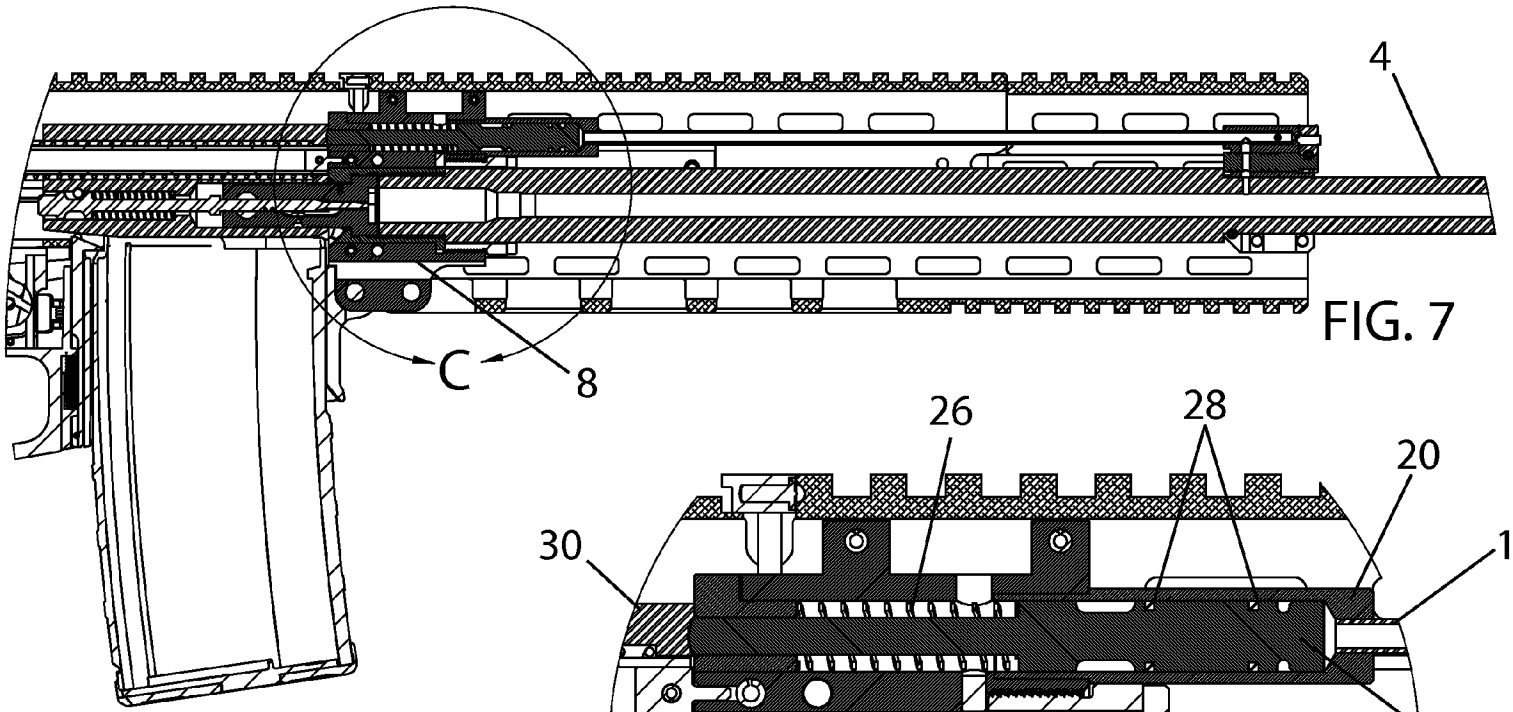
FIG. 7 is a close-up view of the firearm of FIG. 4, in a closed firing position, detailing a gas system in accordance with the present invention.
Figure 8:
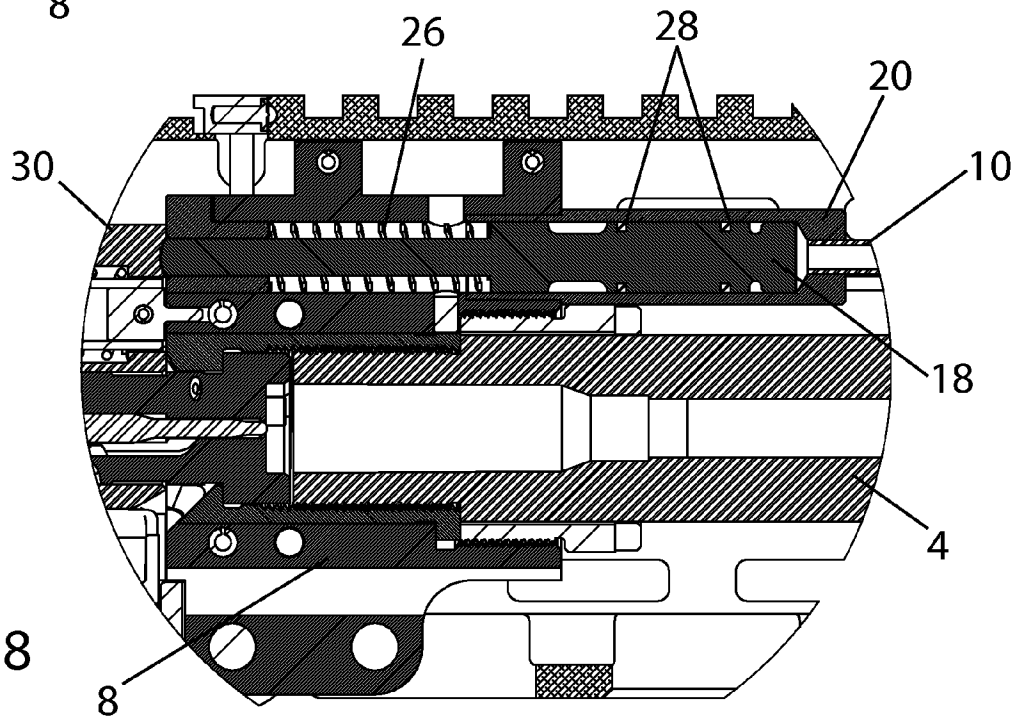
FIG. 8 is a close up view of the rear portion of the gas system of FIG. 7, taken in circle C.

With reference to the FIGS. 1-3, the system 1 resides in a firearm 2, generally above the barrel 4. The system itself comprises a gas tube 10 extending parallel to the barrel 4 of a firearm and is best shown in FIGS. 4-8. The head of the tube 10 resides in gas manifold 12 towards the forward of the barrel 4. Gas manifold 12 taps into barrel 4 to divert gasses from firing into the system. A gas block 16 surrounds the tap 14 and gas manifold 12 to better seal the system 1. At the rear of gas tube 10 is the piston assembly, comprising of piston 18, piston housing 20 coaxial to the piston 18, and sealing bushing 24. Sealing bushing 24 may be of one piece with the piston housing 20. Piston housing 20 is mounted on the trunnion 8 of the barrel 4 and is therefore removed from the weapon's firing group 6. Piston housing 20 may be of any shape suitable for a firearm and it may present heat dissipation geometry, such as fins, to reduce heat buildup in the weapon. An optional spring 26 may reside in the piston housing 20, about the piston 18. Piston 18 resides in such a manner as to interface with bolt carrier group 30. Piston 18 may also feature gas rings 28 (FIG. 8 only) to better seal the piston 18 against the piston housing 20 and increase operational efficiency.

Figure 9:
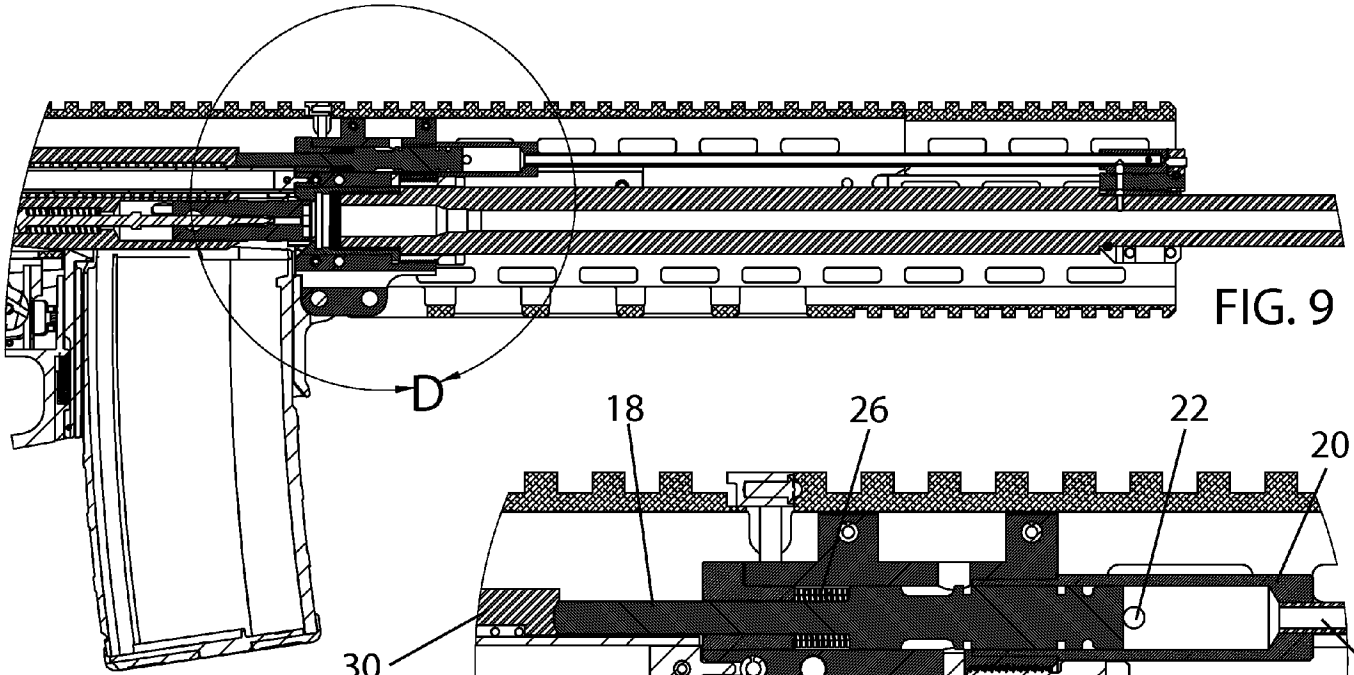
FIG. 9 close-up view of the firearm of FIG. 4, in an open firing position detailing a gas system in accordance with the present invention.
Figure 10:
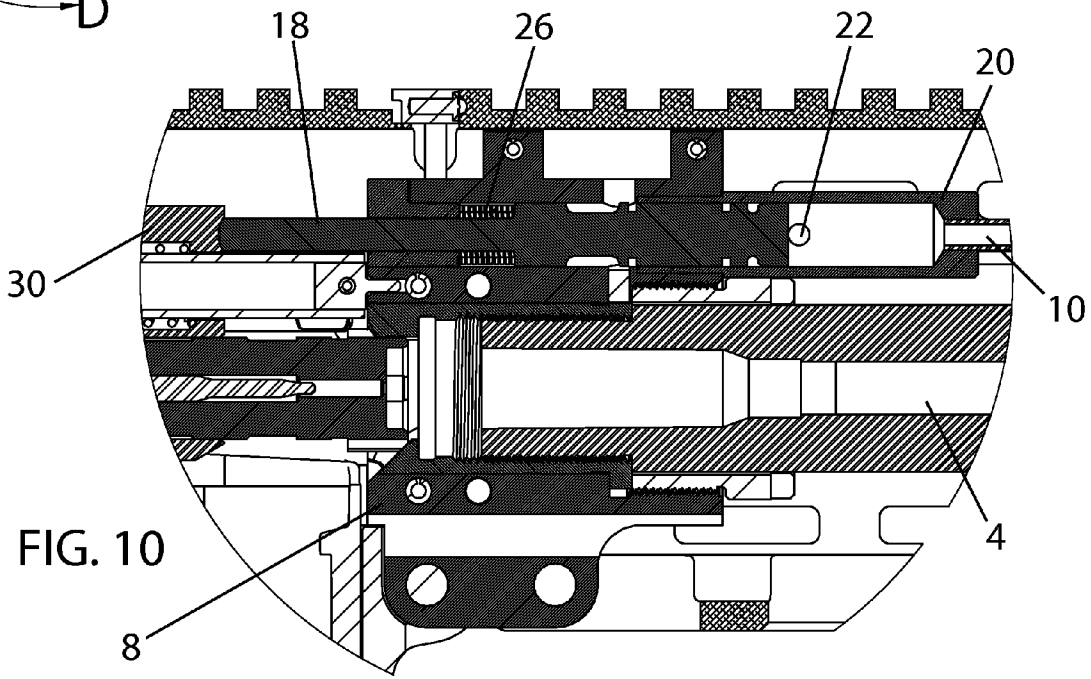
FIG. 10 is a close up view of the rear portion of the gas system of FIG. 9, taken in circle D.
Figures 11, 12:
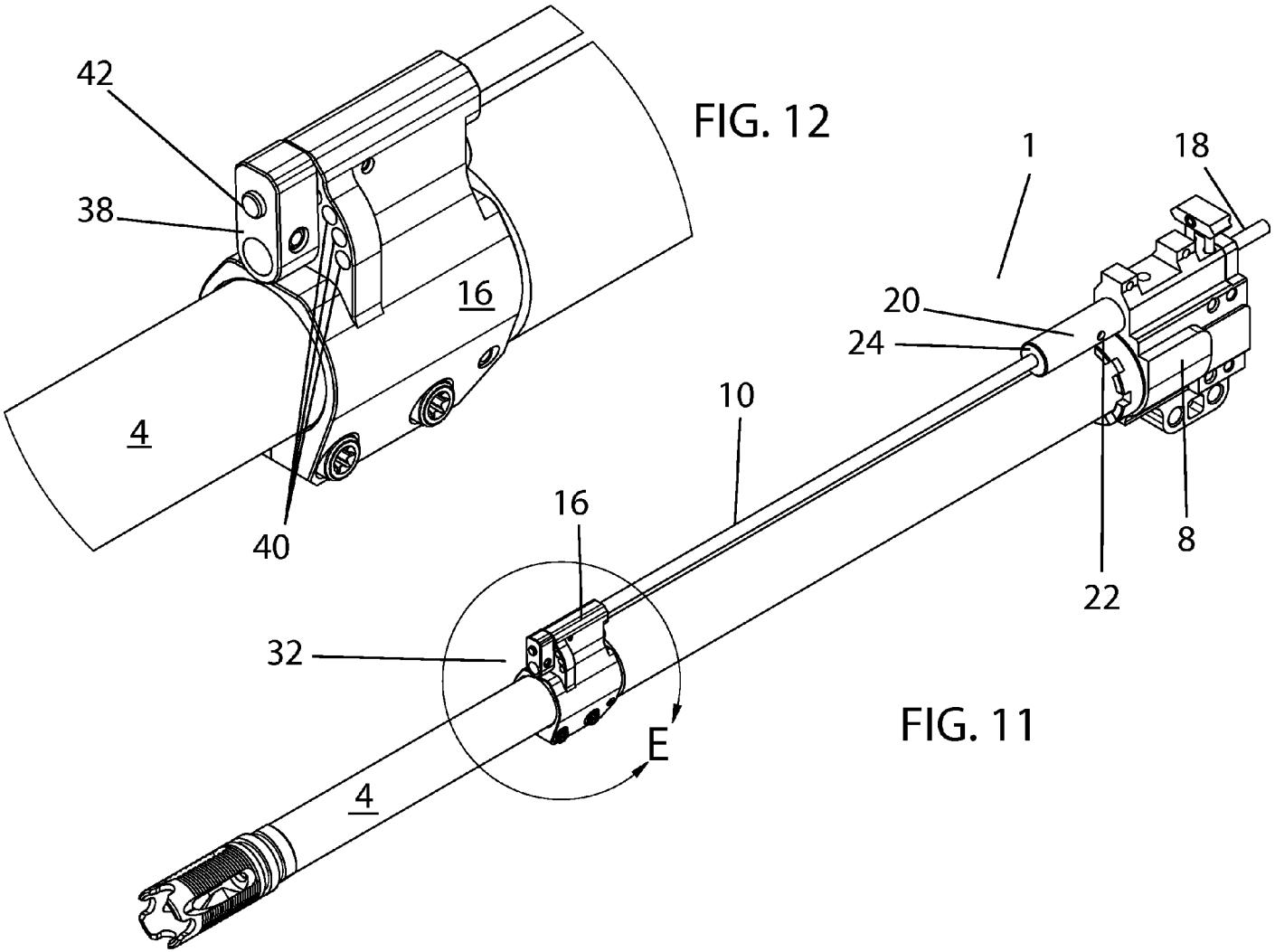
FIG. 11 is a perspective view of a barrel with a gas system in accordance with the present invention.
FIG. 12 is a close-up view of the gas system of FIG. 11, taken in circle E.
Figure 13:
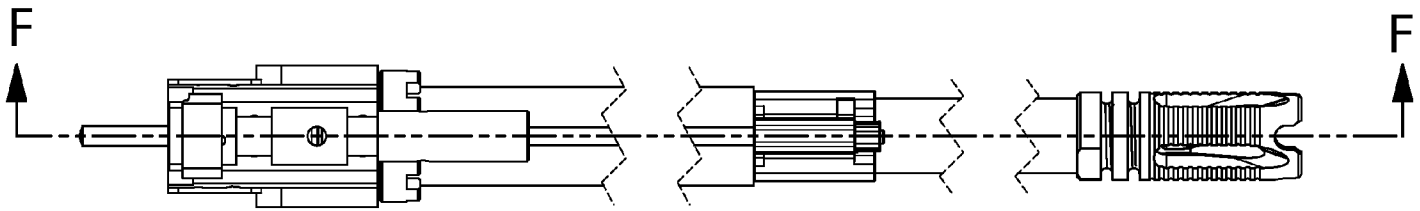
FIG. 13 is a truncated top plan view of the gas system and barrel of FIG. 11.
Figure 14:
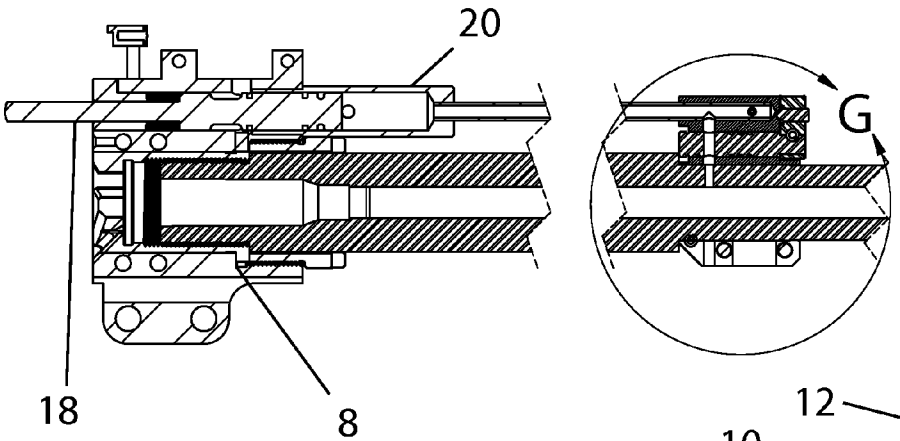
FIG. 14 is a sectional view of the gas system and barrel of FIG. 13, taken alone line F-F.
Figure 15:
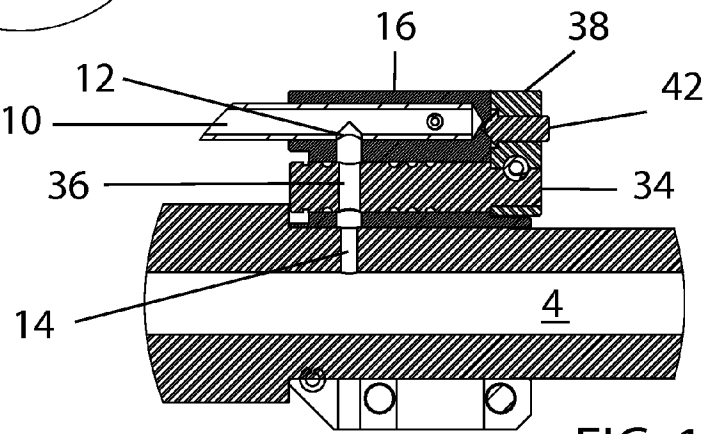
FIG. 15 is a close up sectional view of the gas system and barrel of FIG. 14, taken in circle G, the gas system being in a fully open configuration.
Figure 16:
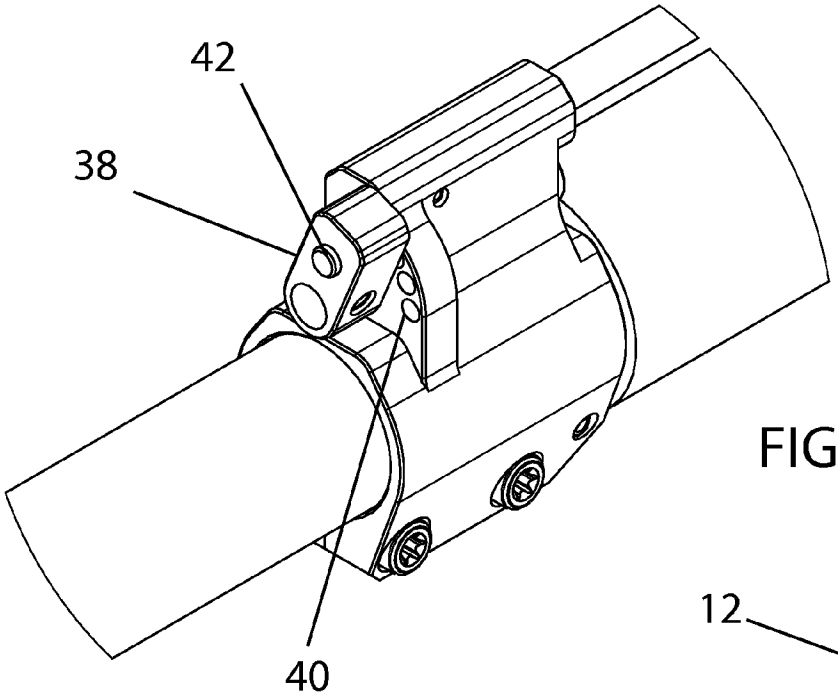
FIG. 16 is a close up view of the gas system of FIG. 11, in a partially open configuration.
Figure 17:
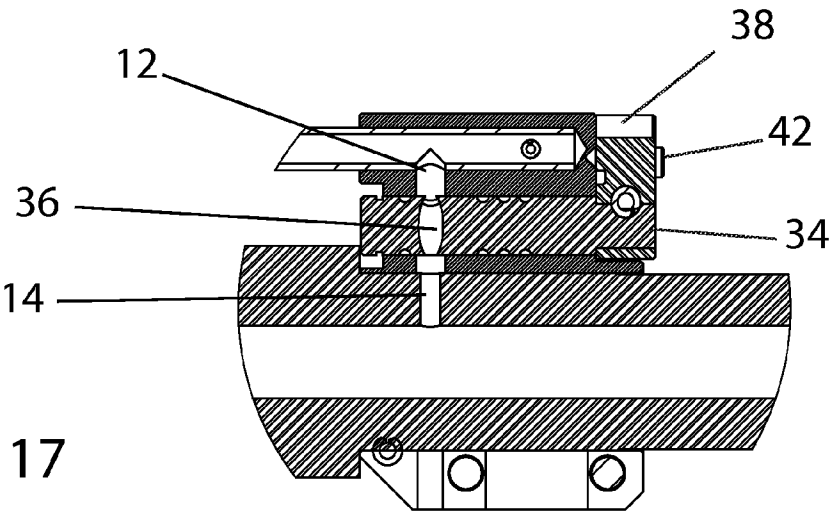
FIG. 17 is a sectional view, along the same view as FIG. 15, the gas system being in a partially open configuration.
Figure 18:
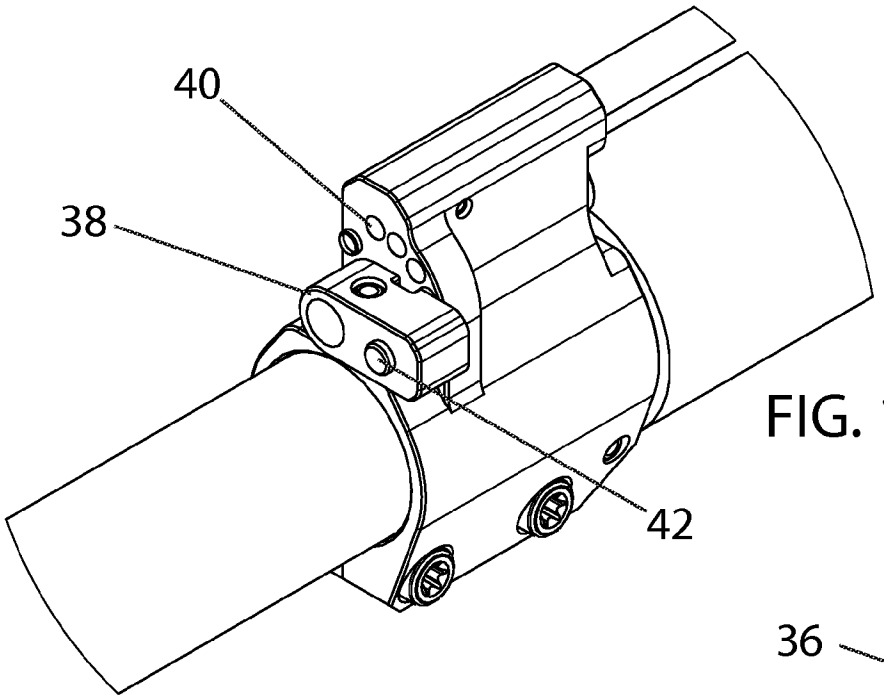
FIG. 18 is a close up view of the gas system of FIG. 11, in a fully closed, or suppressed, configuration.
Figure 19:
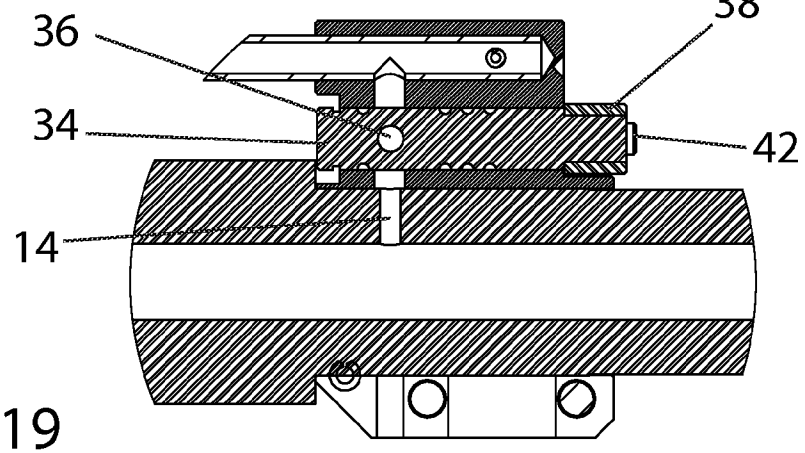
FIG. 19 is a sectional view, along the same view as FIG. 15, the gas system being in a fully closed, or suppressed, configuration.

In use, after firing (FIGS. 9 and 10), the projectile is forced out of the barrel 4 by rapidly expanding gasses. After the projectile passes the tap 14, gas pressure forces some of the gasses into the gas manifold 12 and down the gas tube 10. The gasses then enter the piston housing 20, which is sealed by the sealing bushing 24, and build pressure until the piston 18 slides rearward in the piston housing 20. Piston 18 then forces bolt carrier group 30 rearward as well—thus initiating the cycling the action for the next projectile. Gas pressure is released through vent 22, which is exposed when the piston 18 reaches its rearward position. Simultaneously, spring 26, if present, is compressed. It should be noted that the only movable parts in the gas system 1 is the piston 18 and the optional spring 26. The piston 18 is reset when the weapon's bolt carrier group 30 impinges upon it during the firing cycle. When present, spring 26 decompresses and aids in resetting the piston 18 and may do so in advance of the bolt carrier group's return.

Residing within the gas block 16 is an adjustment system 32, shown in greater detail in FIGS. 11-19. The adjustment system 32 is a rotationally mounted plug 34 within the gas block 16. The plug features a transverse bore 36 residing proximate the tap 14. A handle 38 extends from the plug 34 outside the gas block 16. Rotating the handle 38 rotates the plug 34 and the associated bore 36. As the bore 36 rotates, its relation to the tap 14 varies from in-line with the tap 14, or fully open, (FIGS. 12 and 15), partially in-line with the tap 14 (FIGS. 16 and 17) and perpendicular to the tap 14, or closed, (FIGS. 18 and 19), varying the rate in which gas enters the system 1. Pre-sets are effected by a series of detents 40 radially spaced about the plug 34 on the gas block 16. Handle 38 interacts with the detents 40 with a pin 42. Pin 42 may be either a solid pin, as depicted, a spring biased pin, or a ball and plunger assembly as is known in the art. The detents 40 provide a positive stop of the handle 38, positioning the plug 34 and associated bore 36 in a given relation to the tap 14.

Dimensions of the system will be ultimately dependent upon the weapon platform in which it will be deployed. Materials may be any durable, heat resistant substance such as a metal (ideally steel), durable thermoset plastic or other polymer, ceramic or composite material.

Although the present invention has been described with reference to preferred embodiments, numerous modifications and variations can be made and still the result will come within the scope of the invention. As an example, the piston 18 and piston housing 20 may be inversed, such that a piston translates along and outside a piston housing rather than internal of one. No limitation with respect to the specific embodiments disclosed herein is intended or should be inferred.

What is claimed is:

1. A gas operating system for a firearm, said firearm comprising a barrel cantileverally attached to a receiver at a barrel trunnion and defining an axis and a bolt actuated operating system, said bolt actuated operating system further comprising a bolt carrier group slidable between first position proximate the trunnion and a second position along the axis, and a firing mechanism located distally on the firearm, behind a magazine well which is, in turn, behind the barrel and barrel trunnion, the gas system comprising:

a. a gas manifold with fluid communication into a fore portion of the barrel through a tap;

b. a hollow gas tube extending rearward from and having fluid communication with the gas manifold;

c. a piston housing situated on the barrel trunnion and encompassing an end of the hollow gas tube thereby being in fluid communication with the same;

d. a piston residing within said piston housing, capable of lateral motion along an axis of the barrel and having a portion of the piston which extends outside the piston housing when in a rearward orientation; and e. a spring contained within the piston housing positioned to bias the piston in a forward orientation;

wherein the piston and piston housing present a relatively gas tight chamber and, upon firing of the firearm, released gasses are diverted through the tap, into the gas manifold, through the hollow gas tube and into the piston housing, where said gasses build pressure to actuate the piston in a rearward direction such that the piston extends outside of the piston housing, impinges upon and forces the bolt actuated operating system likewise rearward from the first position to the second position, releasing pressure therein and allowing the piston to be returned to a forward position when the bolt actuated operating system returns to its first position.

2. The gas operating system of claim 1, further comprising at least one gas block positioned about the tap.

3. The gas operating system of claim 2, the gas block further comprising a rotational plug, with a transverse bore proximate the tap such that rotating the plug rotates the bore and regulates flow of gas into the gas system.

4. The gas operating system of claim 3, further comprising at least one gas ring about the piston.

5. The gas operating system of claim 4, the piston housing further comprising heat dissipating geometry.

6. The gas operating system of claim 1, further comprising at least one gas ring about the piston.

7. The gas operating system of claim 6, the piston housing further comprising heat dissipating geometry.

8. The gas operating system of claim 1, the piston housing further comprising heat dissipating geometry.

* * * * *